US007850582B2

(12) United States Patent
Smith

(10) Patent No.: US 7,850,582 B2
(45) Date of Patent: Dec. 14, 2010

(54) FLEXIBLE EXERCISE DEVICE AND RELATED SYSTEMS

(76) Inventor: Francis J. Smith, 1021 Highland Park, Fallbrook, CA (US) 92028

( * ) Notice: Subject to any disclaimer, the term of this patent is extended or adjusted under 35 U.S.C. 154(b) by 0 days.

(21) Appl. No.: 12/001,477

(22) Filed: Dec. 10, 2007

(65) Prior Publication Data

US 2009/0149304 A1 Jun. 11, 2009

(51) Int. Cl.
*A63B 21/00* (2006.01)

(52) U.S. Cl. ..... 482/121; 482/126; 482/91

(58) Field of Classification Search ..... 482/904, 482/907, 126, 121, 91, 129
See application file for complete search history.

(56) References Cited

U.S. PATENT DOCUMENTS

| | | | | |
|---|---|---|---|---|
| 1,023,756 | A * | 4/1912 | Pons | 482/128 |
| 2,806,699 | A * | 9/1957 | Spooner | 482/126 |
| 4,565,367 | A * | 1/1986 | Kaiser | 482/131 |
| 4,863,159 | A * | 9/1989 | Brown, Jr. | 482/126 |
| D309,933 | S | 8/1990 | Brown, Jr. | |
| 5,004,226 | A | 4/1991 | Brown, Jr. | |
| 5,147,262 | A * | 9/1992 | Hymanson | 482/110 |
| 5,571,064 | A * | 11/1996 | Holm | 482/129 |
| 7,314,438 | B1 * | 1/2008 | Clark et al. | 482/126 |
| 2004/0185990 | A1 * | 9/2004 | Orescan et al. | 482/126 |
| 2004/0242387 | A1 * | 12/2004 | Benach | 482/126 |
| 2005/0079962 | A1 * | 4/2005 | Brown | 482/121 |
| 2005/0233877 | A1 * | 10/2005 | Lin | 482/126 |

FOREIGN PATENT DOCUMENTS

TW 252445 12/2004

OTHER PUBLICATIONS www.msfitness.com Ultraflex2 Names Ms. Fitness Product of the Year, Winter 2006, pp. 84-85.
www.msfintness.com, Ms. Fitness, Ultraflex Your Way to Fitness, display until Jan. 20, 2007, cover.

* cited by examiner

*Primary Examiner*—Jerome W Donnelly
(74) *Attorney, Agent, or Firm*—Michael H Bourdaa

(57) ABSTRACT

An exercise device comprises an elongate rod having opposite ends each being configured to be grasped by a user. The rod includes a flexible inner core having a pair of opposite ends and an outer sheath substantially circumscribing at least a central portion of the inner core. A pair of grip sections are each positioned on an opposite end of the rod, the grip sections being configured to allow a user to grasp each end of the rod when performing exercises. At least one end cap is fixed to one of the opposite ends of the rod, the end cap including engaging structure associated therewith to facilitate engagement with a safety strap. A safety strap is engaged with the end cap and is configured to be releasably secured to the user to prevent accidental release of a grip section of the rod.

22 Claims, 6 Drawing Sheets

FLEXIBLE EXERCISE DEVICE AND RELATED SYSTEMS

FIELD OF THE INVENTION

The present invention relates generally to systems for use in exercising the human body.

BACKGROUND OF THE INVENTION

Variable resistance exercise devices have been popular for a number of years. Such devices generally provide variable, non-linear resistance in response to force applied by a user in order to exercise various areas of the user's body. Among other applications, variable resistance devices have been utilized in so-called "nautilus" machines, which are typically relatively permanent, stationary devices. While such stationary devices have proved effective and popular, they are not easily portable and so may not be easily adaptable into the daily routines of many people.

Portable variable resistance devices have been developed and adopted for use by a number of people. Examples of these types of devices are disclosed in U.S. Pat. No. 4,863,159 and U.S. Pat. No. 5,004,226, each of which were issued to Gordon Brown, Jr., and each of which is incorporated herein by reference. These types of devices are essentially elongate, flexible rods that are grasped at each end by a user and bent or flexed during a workout. While such portable devices have enjoyed success, there are a number of problems with known portable devices such as these. For example, such devices are often prone to failure earlier in the product life than is desirable. Also, such devices can be non-intuitive to use. In addition, while a variety of exercises can be performed by simply grasping such devices with one hand at each end, it has been found that some users desire a more varied workout experience than those that have been available to date.

SUMMARY OF THE INVENTION

The present invention provides an exercise device, including an elongate rod having opposite ends each being configured to be grasped by a user. The rod can include a flexible inner core having a pair of opposite ends. An outer sheath can substantially circumscribe at least a central portion of the inner core. A pair of grip sections can each be positioned on an opposite end of the rod, the grip sections being configured to allow a user to grasp each end of the rod when performing exercises. At least one end cap can be fixed to one of the opposite ends of the rod, the end cap including engaging structure associated therewith to facilitate engagement with a safety strap. A safety strap can be engaged with the end cap and can be configured to be releasably secured to the user to prevent accidental release of a grip section of the rod. In accordance with another aspect of the invention, an exercise system is provided, including an elongate rod having opposite ends each suitable to be grasped by a user when performing exercises. At least one end harness can include a rod engaging portion, the rod engaging portion operable to be removably engaged with an end of the rod; and an auxiliary engagement portion, the auxiliary engagement portion operable to be engaged with a structure distinct from the rod to enable a user to temporarily secure the rod to the distinct structure to perform exercises.

In accordance with another aspect of the invention, an exercise device is provided, including an elongate rod that include a flexible inner core having a pair of opposite ends. An outer sheath can substantially circumscribe the inner core and a pair of grip sections can each be positioned on an opposing end of the rod. The grip sections can be configured to allow a user to securely grasp each end of the rod to perform exercises. Indicating structure can be associated with the rod, the indicating structure being attached to or formed integrally with the rod and can provide a visual indication of a flexural orientation of the rod.

There has thus been outlined certain features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION OF THE PREFERRED EMBODIMENT(S)

Figure 1:
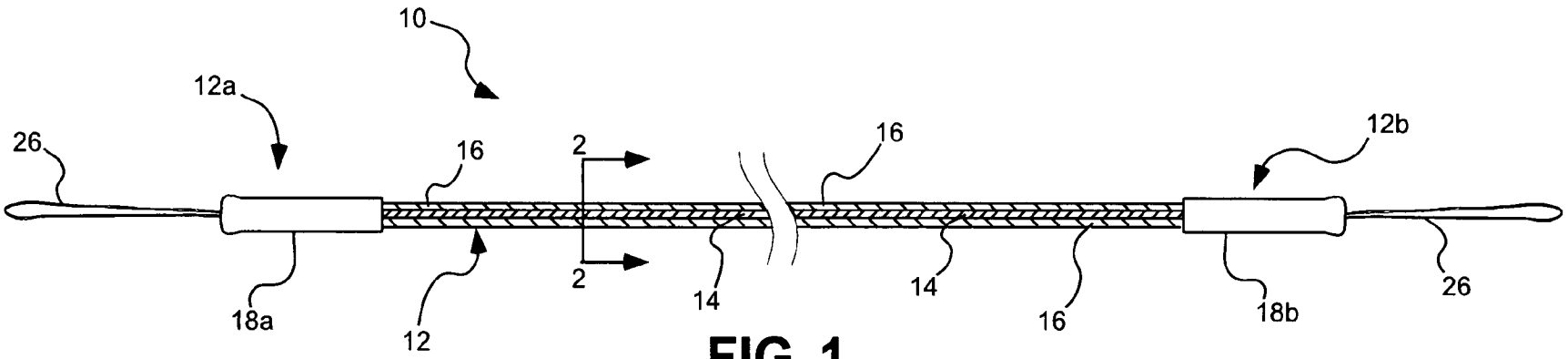
FIG. 1 is a partially sectioned view of an exercise device in accordance with an embodiment of the invention.

Before the present invention is disclosed and described, it is to be understood that this invention is not limited to the particular structures, process steps, or materials disclosed herein, but is extended to equivalents thereof as would be recognized by those of ordinary skill in the relevant arts. It should also be understood that terminology employed herein is used for the purpose of describing particular embodiments only and is not intended to be limiting. In describing and claiming the present invention, the following terminology will be used in accordance with the definitions set forth below.

It is noted that, as used in this specification and the appended claims, the singular forms "a" and "the" include plural referents, unless the context clearly dictates otherwise. Thus, for example, reference to an "upright arm" includes one or more of such arms.

As used herein, relative terms may be used to refer to various components of exercise equipment, such as "upper," "lower," "upwardly," "downwardly," etc. It is to be understood that these terms in no way limit the present invention but are used to aid in describing the components of the exercise equipment, and surrounding structures generally, in the most straightforward manner.

As used herein, a "structure" that is distinct from the rod can be one of a variety of structures typically found in an environment where exercises are performed. Examples of such structures include, without limitation, doors and door-jambs, tables and chairs, stationary exercise equipment and the like. In addition, a structure that is distinct from the rod can include a portion of a user's body that is not used to grip the exercise rod. Thus, in one aspect of the invention, the structure that is distinct from the rod can include a user's leg, ankle, forearm, wrist, etc. In this aspect of the invention, one end of the rod can be secured to the leg, ankle, etc., while the other end of the rod can be grasped or gripped by the user's hand.

As used herein, the term "substantially" refers to the complete or nearly complete extent or degree of an action, characteristic, property, state, structure, item, or result. For example, when an object or group of objects is/are referred to as being "substantially" liquid-tight, it is to be understood that the object or objects are either completely liquid-tight or are nearly completely liquid tight. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, an opening that is "substantially free of" material would either completely lack material, or so nearly completely lack material that the effect would be the same as if it completely lacked material. In other words, an opening that is "substantially free of" material may still actually contain some such material as long as there is no measurable effect as a result thereof.

As used herein, the term "about" is used to provide flexibility to a numerical range endpoint by providing that a given value may be "a little above" or "a little below" the endpoint.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 inch to about 6 inches" should be interpreted to include not only the explicitly recited values of about 1 inch to about 6 inches, but also include individual values and sub-ranges within the indicated range. This same principle applies to ranges reciting only one numerical value and should apply regardless of the breadth of the range or the characteristics being described.

Figure 2B:
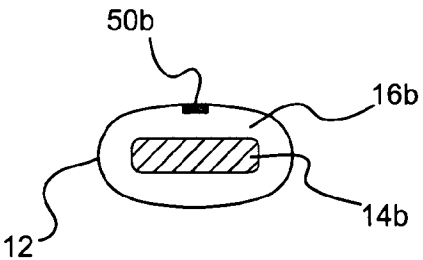
FIG. 2B is a sectional view of another embodiment of the exercise device of FIG. 1, taken along section 2-2 of FIG. 1.
Figure 2A:
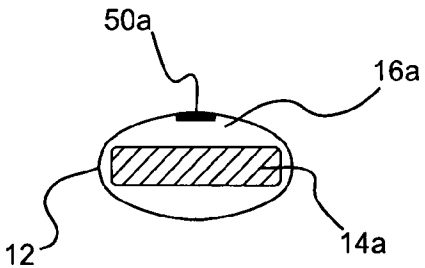
FIG. 2A is a sectional view of one embodiment of the exercise device of FIG. 1, taken along section 2-2 of FIG. 1.

As illustrated generally in FIG. 1 (with alternate embodiments illustrated in cross section in FIGS. 2A and 2B), in one aspect of the present invention, an exercise device 10 is provided that can include an elongate rod 12 having opposite ends 12*a*, 12*b* that are each configured to be grasped by a user (not shown). The rod can include a flexible, yet generally rigid, inner core 14 having a pair of opposite ends corresponding to the ends of the rod. An outer sheath 16 can substantially circumscribe at least a central portion of the inner core. A pair of grip sections 18*a*, 18*b* can be positioned on opposite ends of the rod to allow a user to grasp each end of the rod when performing exercises.

During a typical use of the device, a user would grasp one of the grip portions 18*a* in one hand and the other grip portion 18*b* in the other hand. Once a secure grip is undertaken, the user could then perform a series of flexural maneuvers with the rod to exercise various areas of the user's body. The exercise rod system can be used in a variety of exercises, the details of which will not be expounded upon herein. One skilled in the art of the use of such devices, having possession of the disclosure herein, could readily incorporate the present device into a variety of exercise regimes.

Figure 3B:
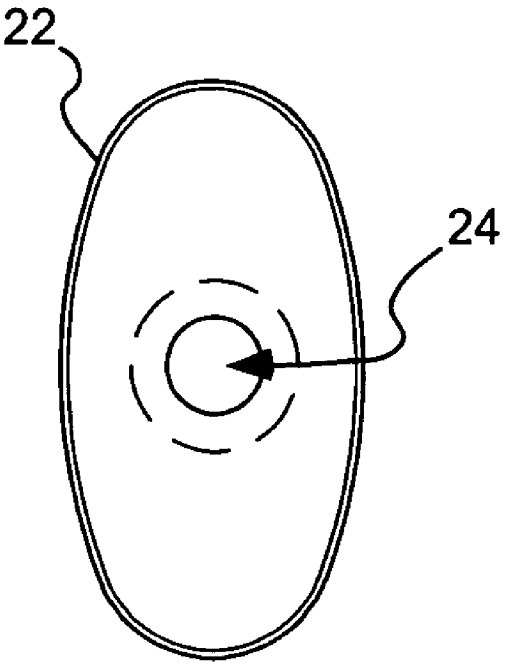
FIG. 3B is a top view of the end cap of FIG. 3A.
Figure 3A:
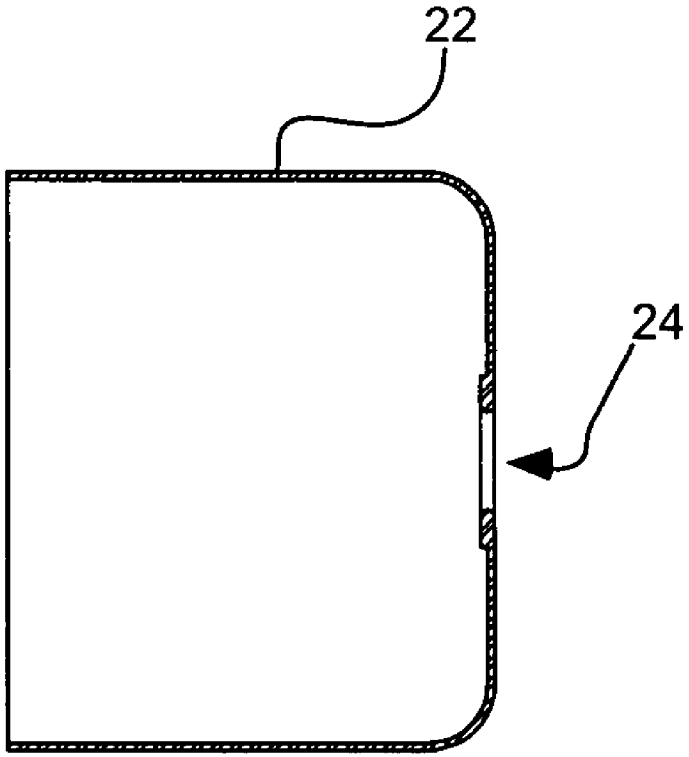
FIG. 3A is a side, sectional view of an end cap in accordance with an embodiment of the invention.
Figure 4:
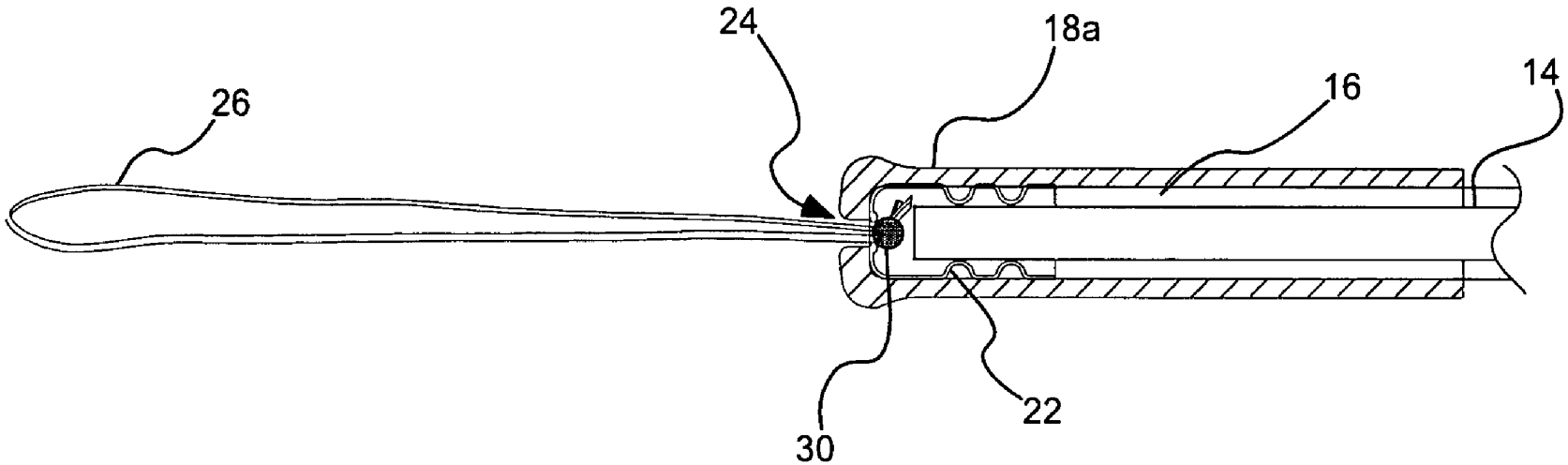
FIG. 4 is a side, partially sectioned view of a grip portion of an exercise device in accordance with an embodiment of the invention.

As shown in FIGS. 3A, 3B and 4, an end cap 22 can be fixed to one of the opposite ends of the flexible inner core 14, or to the outer core 16 (the end cap is shown attached in FIG. 4). In one aspect of the invention, the end cap can engage the outer core in such a manner so as to be spaced only a very small distance from the inner core (in other words, the end cap can extend through or into the outer core a distance that results in portion of the end cap lying immediately adjacent to the inner core). The end cap can include engaging structure 24 associated therewith to facilitate engagement with a safety or wrist strap (26 in FIGS. 1 and 4). The safety strap can be engaged with the end cap and can be configured to be releasably secured to the user to prevent accidental release of a grip section of the rod (and thus the end of the rod). In a typical use, a user will generally insert his or her hand through the wrist strap prior to grasping one of the grip sections 18*a*, 18*b*. During use, if the grip section happens to slip from the user's hand, the wrist or safety strap can prevent the end of rod from forcibly contacting the user, or nearby objects, to prevent possible injury to the user or damage to the nearby objects.

The end cap 22 can be coupled to the rod 10 in a variety of manners. In one aspect, the end cap is comprised of a deformable material and can be fixedly crimped onto the inner core 14 of the rod. In this manner, the end cap is securely fixed to the substantially rigid inner core material to ensure that the end cap is not pulled from the rod by way of forces applied to the end cap via the wrist or safety strap 26. The deformable material of the end cap will generally comprise a metallic material, such as steel. It is contemplated that other methods could be utilized to attach the end cap to the rod, including adhesives, threaded couplers, and various combinations thereof. In one embodiment (not shown), a through-hole is formed in the rod and the end cap, and a pin is placed in the through-hole to secure the end cap to the rod. As will be appreciated, generally a pair of end caps will be included with the exercise device, one fixed to each of the opposite ends of the inner core.

In the embodiment shown in FIG. 4, the engaging structure 24 associated with the end cap 22 comprises an opening through which the wrist or safety strap 26 can extend. The safety strap can include an enlarged portion 30 sufficiently larger than the opening 24 that the enlarged portion prevents the strap from being pulled through the opening (in an outward direction to the left of FIG. 4). The enlarged portion can be formed in a variety of manners: in the embodiment shown the enlarged portion is formed by knotting or tying ends of the safety strap. In other embodiments (not shown), an enlarged structure can be crimped over the ends of the safety strap, or the ends can be tied to an enlarged structure, or bonded to an enlarged structure (or wrapped, folded, etc., and bonded into an enlarged structure).

By fixing the end cap to the inner core, and by attaching or including the enlarged structure to or with the ends of the safety strap, the safety strap will be maintained coupled to the rod through the life cycle of the exercise device.

The inner core 14 and the outer sheath 16 can be formed from a variety of materials. Generally, however, the outer sheath will be a pliable material that is relatively easily and elastically bent. The inner core will generally be relatively more rigid, and more difficult to flex, in order to provide the resistance required from the device. In one aspect of the invention, the inner core material includes: a fiberglass roving material (E Glass) present in an amount of about 70% and having an elongation rating of about 4-5%; and a polyethylene resin present in an amount of about 30% and having an elongation rating of about 4-5%.

The outer core can be formed from a variety of materials, as well. Examples of outer core materials (in exemplary concentrations) include, without limitation, Polyvinyl Chloride 56% (PVC); Dioctyl Phthalate 34% (DOP); Modifiers Stearic Acid Zinc and Stearic acid; a 6.6%; Epoxidized Soybean oil 1.7%; and Non-Toxic Ca/Zn Stabilizer 1.7%.

Figure 5A:
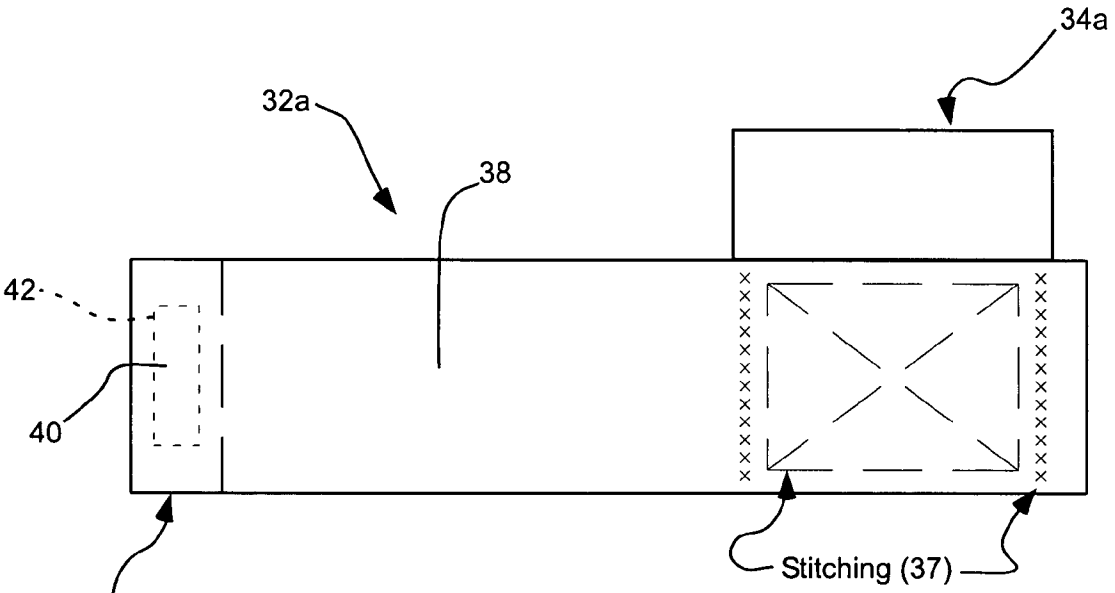
FIG. 5A is a side view of an end harness in accordance with an embodiment of the invention.
Figure 5B:
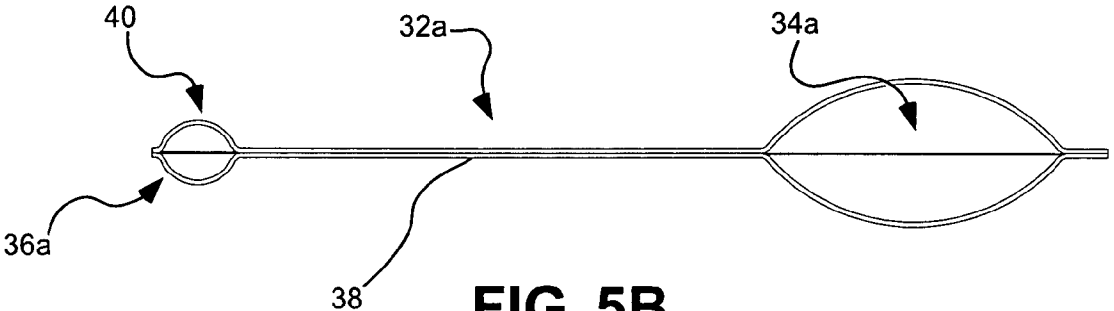
FIG. 5B is a top view of the end harness of FIG. 5A.

Turning now to FIGS. 5A and 5B, in one aspect of the invention the exercise system can include at least one end harness 32*a* that can be removably attachable to an end of the rod (the rod is not shown in these FIGS). The end harness can include a rod engaging portion 34*a* that can be operable to be removably engaged with an end of the rod. In the embodiment shown, the rod engaging portion comprises a pocket or cavity into which one of the ends of the rod can be engaged. The pocket or cavity can be sized to snugly receive the end of the rod, and can be fully or partially enclosed (e.g., the pocket can include one or more open portions that are not large enough to allow the rod to pass through the pocket). The end harness can also include an auxiliary engagement portion 36*a* that can be operable to be engaged with a structure distinct from the rod (the distinct structure not shown) to enable a user to temporarily secure the rod to the distinct structure while performing exercises.

In the embodiment shown, the auxiliary engagement portion comprises a flap 38 extending from the rod engaging portion 34*a*. The flap can be configured to fit between a closed door and a door jamb (neither shown) and can terminate in an enlarged portion 40. The enlarged portion can be sized to be unable to fit between the closed door and a door jamb. In use, the strap 38 would be positioned adjacent a door jamb, after which a door can be closed into a frame of the door jamb to thereby wedge the strap between the door and the doorjamb. The enlarged portion, unable to fit between the closed door and the doorjamb, will retain the end harness in place between the two, even if significant force is applied to the harness by way of the exercise rod (which is held within the pocket 34*a*).

The enlarged portion 36*a* of the end harness 32*a* can be formed in a variety of manners: in one aspect the enlarged portion includes a cylindrical rod or dowel 42 (FIG. 5A) sewn between layers of the end harness. The rod can be formed of a metallic material, wooden material or a relatively hard polymeric material.

Figure 6A:
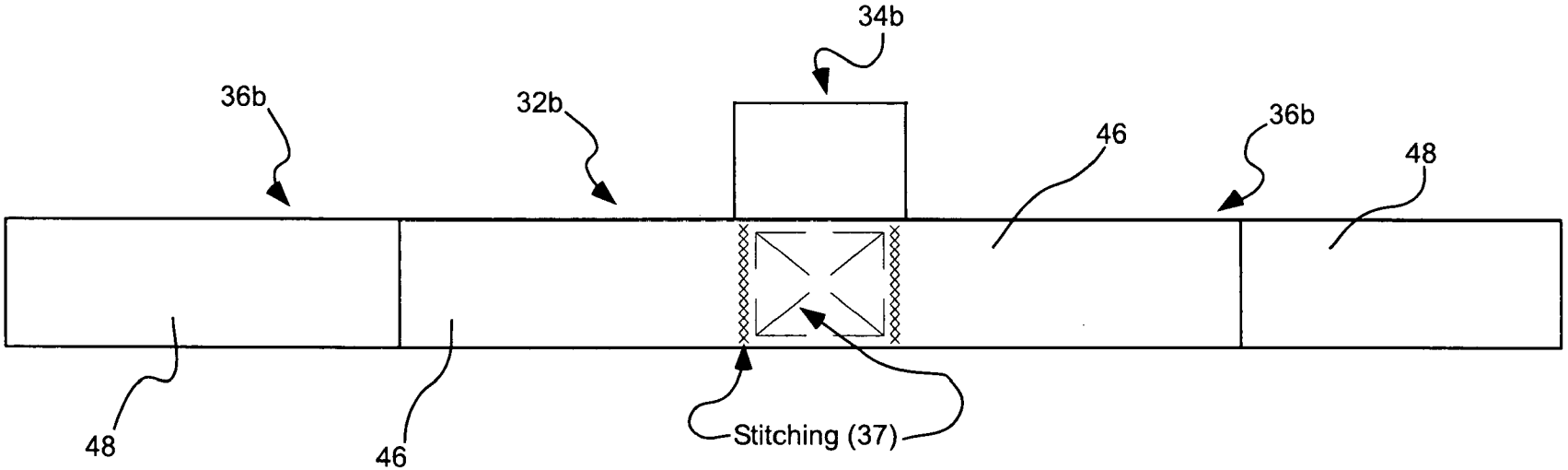
FIG. 6A is a side view of another end harness in accordance with an embodiment of the invention.
Figure 6B:
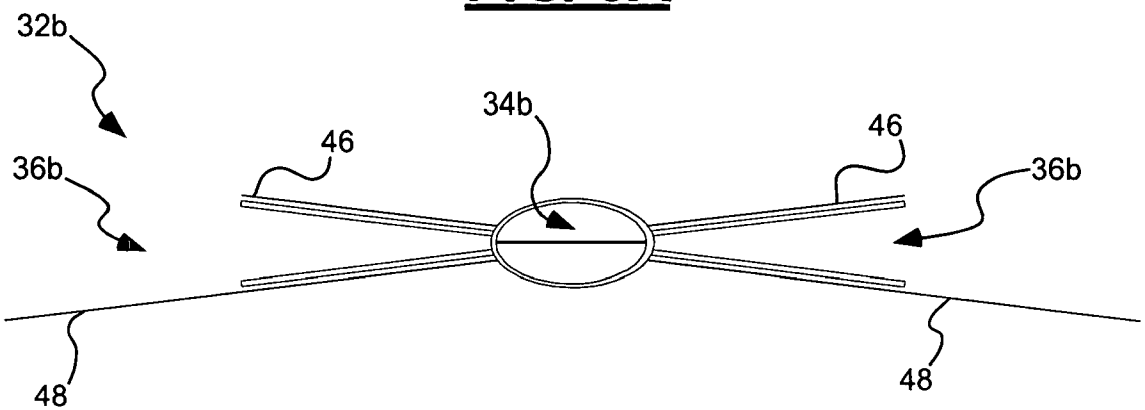
FIG. 6B is a top view of the end harness of FIG. 6A.

As shown in FIGS. 6A and 6B, in one aspect of the invention, end harness 32*b* can include a similar rod engagement portion 34*b*. In this aspect, however, the auxiliary engagement portion 36*b* (two are shown) can include one or more releasable strap sets, each comprised of a primary strap 46 and a secondary strap 48 that can be sized to be releasably attached to a structure distinct from the rod including, without limitation, a limb of the user. The primary and secondary straps can be releasably securable to one another in a variety of manners. In one aspect, the primary 46 and secondary 48 straps can be coupleable to one another by way of a commonly known hook-and-loop device such as that sold under the tradename Velcro™, as would be readily understood by one of ordinary skill in the relevant art having possession of this disclosure. Various buckles, snaps, etc., can also be used to secure the straps one to another.

In one exemplary application, an end of the exercise rod (not shown in these figures) can be inserted within and held by pocket 34*b*. One of the releasable strap sets can be attached about an ankle or a lower leg of a user. The user can then grasp the grip portion of the rod and perform a variety of exercises while the first end of the exercise rod is held securely adjacent his or her ankle or lower leg (even while the ankle or lower leg is being moved about). Of course, the auxiliary engagement portion 36*b* can also be coupled to other portions of the user's body, including his or her or arms or wrists. Also, the auxiliary engagement portion can be coupled to surrounding structure, including nearby exercise equipment, table legs, chair legs, etc.

Pockets 34*a* and 34*b* can be formed in (or attached to the harnesses) in a variety of manners. In one embodiment, the pockets are defined by stitching 37 which can secure two opposing fabric pieces to one another to form sides of the pockets. In one aspect of the invention, a relatively soft material, such as foam or soft fabric, can be installed within the auxiliary engagement portion 36*b* to provide a more comfortable interface between the harness and the user's hand, wrist, ankle, etc.

Returning to FIGS. 2A and 2B, in one aspect of the invention, the elongate rod can include indicating structure 50*a*, 50*b* associated therewith, the indicating structure being attached to or formed integrally with the rod. The indicating structure can provide a visual indication of a flexural orientation of the rod. In the embodiment shown in FIGS. 2A and 2B, the indicating structure can extend longitudinally along a length of the rod and can be painted onto the rod, or can be formed integrally with the rod from a material that appears visually distinct from a remaining portion of the rod.

The indicating structure can provide visual information to a user of the optimal direction in which the rod should be flexed while performing exercises. As will be appreciated, in the case where the rod is formed in such a manner that a stiffness of the rod varies with direction, a user may not be able to discern which direction he or she should be flexing the rod (this is particularly true of a rod formed with a uniform, cylindrical outer surface that has a stiffness aspect that is directionally varied). The directional indicator can provide information to the user to aid the user in properly aligning his or her hands on the rod prior to beginning his or her exercise regime.

In addition to the visually identifiable stripe formed on or in the rod, the indicating structure can comprise an eccentric cross section formed as part the rod. Thus, in the embodiments shown in FIGS. 2A and 2B, an external portion of the rod includes a wider cross section along the axis in which the rod will flex with the least amount of resistance (e.g., the rod shown in FIG. 2A will bend much more easily in an up-and-down direction than a side-to-side direction, relative to the plane of FIG. 2A).

Figure 7A:
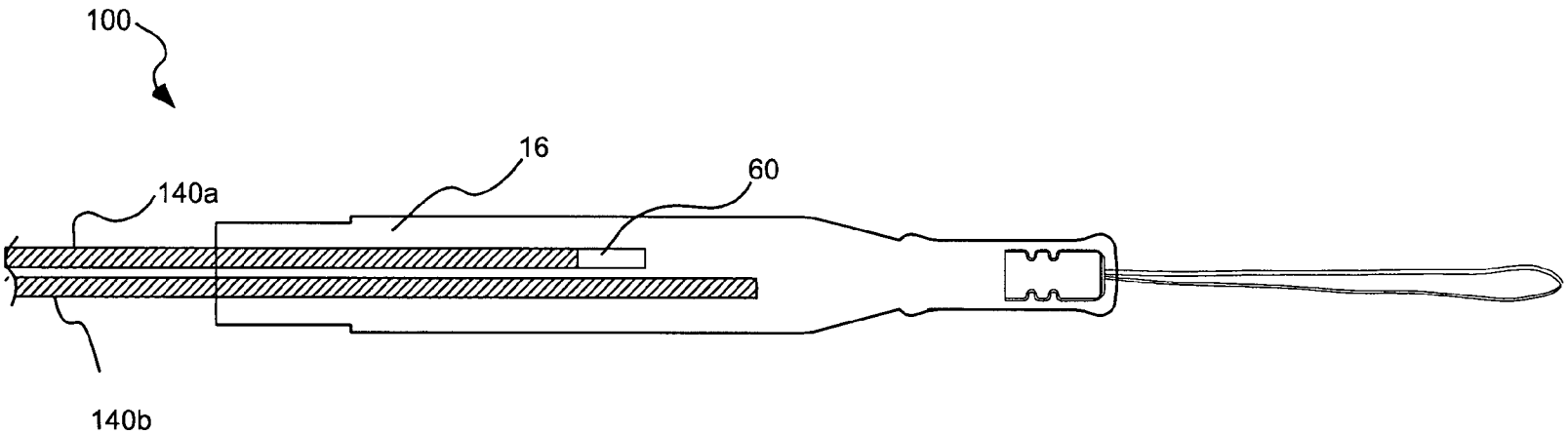
FIG. 7A is partial, sectional view of an exercise device in accordance with another aspect of the invention.
Figure 7B:
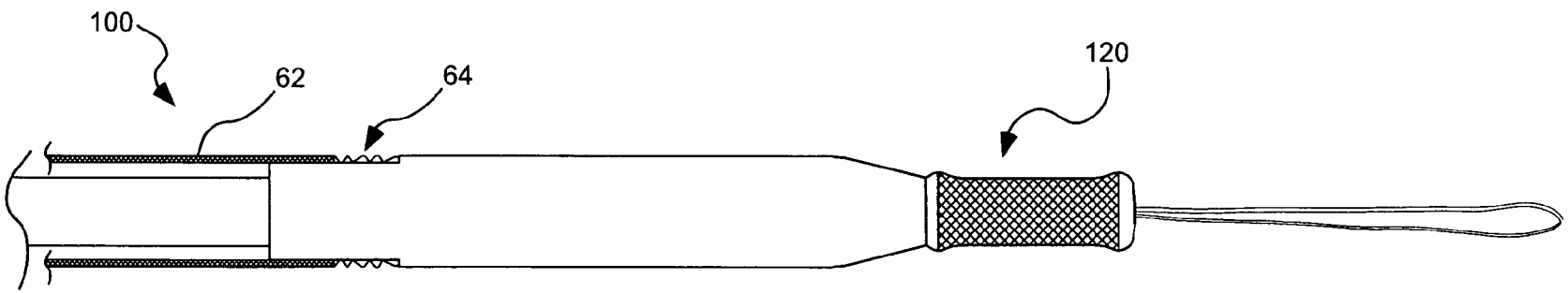
FIG. 7B is a partial, sectional view of the exercise device of FIG. 7A.

Turning now to FIGS. 7A and 7B, in one embodiment of the invention, an exercise device 100 can be provided in which more than one inner core can be provided within an outer sheath 16. As will be appreciated, using multiple inner cores can provide design flexibility to allow an overall stiffness of the rod to be tailored to a particular product design. In the embodiment shown, two inner cores 140*a*, 140*b* can be provided, and can be spaced from one another. The outer sheath can substantially circumscribe each of the inner cores (including the space between the inner cores).

It will be appreciated that, as the overall rod 100 is flexed, the inner cores may individually experience varying degrees of flexure, with the core positioned on an inside radius of the bend flexing more than the core positioned on an outside radius of the bend (e.g., the "inner" core has a tighter bend radius). To accommodate for this difference, a cavity 60 can be formed in the outer sheath 16 to enable the core (140*a* in this example) to move longitudinally relative to the outer sheath, if necessary. In one aspect of the invention, each of the two cores can be fixed on one end of rod, and can include a cavity on the other end of the rod. In this manner, one end of each core can be free to slide within a cavity, while the other end remains fixed. While not so required, in one aspect, two inner cores are provided and are fixed on opposite ends of the device (and thus are free to slide within a cavity on opposite ends of the device). It has been found that this opposing relationship provides smooth operation, even as the rod is flexed from one extreme bending angle to an opposing extreme bending angle.

As shown in FIG. 7B, an outer cover material 62 can be provided over the central rod section with a flexible interface material 64 coupled between the cover material and the grip portion 120 of the rod 100. The flexible interface material can be configured similar to an "accordion" interface, and can compress or extend as necessary to accommodate varying degrees of bend of the rod.

Exercise rods in accordance with the present invention can be provided in a variety of strengths. Rods can be provided with resistances (at full flexure) of about 3.5, 7.5, 10, 15, 20 and 30 lbs. The present invention provides a variety of variable design parameters that can be easily modified to provide a targeted resistance.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An exercise device, comprising:

an elongate rod having opposite ends each being configured to be grasped by a user, the rod including:

a flexible inner core having a pair of opposite ends, said inner core consisting essentially of between 60% and 85% (by weight) fiberglass rods, and between 15% and 40% (by weight) of thermoset resin buffer material;

an outer sheath substantially circumscribing at least a central portion of the inner core;

a pair of grip sections, each being positioned on an opposite end of the rod, the grip sections being configured to allow a user to grasp each end of the rod when performing exercises;

at least one end cap, fixed to one of the opposite ends of the rod, the end cap including engaging structure associated therewith to facilitate engagement with a safety strap;

a safety strip, engaged with the end cap and being configured to be releasably secured to the user to prevent accidental release of a grip section of the rod and herein he rod engaging structure of the strap comprises a pocket into which one of the opposite ends of the rod is insert able to temporarily secure the strap to the rod.

2. The exercise device of claim 1, wherein the at least one end cap is comprised of a deformable material and is fixedly crimped onto rod.

3. The exercise device of claim 1, wherein the engaging structure associated with the end cap comprises an opening.

4. The exercise device of claim 3, wherein the safety strap extends through the opening and includes an enlarged portion sufficiently larger than the opening such that the enlarged portion prevents the strap from being pulled through the opening.

5. The exercise device of claim 1, wherein a grip section substantially circumscribes the end cap.

6. The exercise device of claim 1, further comprising a pair of end caps, each fixed to an opposite end of rod.

7. The exercise device of claim 1, further comprising at least one end harness, removably attachable to an end of the rod, the end harness having:

a rod engaging portion, the rod engaging portion operable to be removably engaged with an end of the rod; and an auxiliary engagement portion, the auxiliary engagement portion operable to be engaged with a structure distinct from the rod to enable a user to temporarily secure the rod to the distinct structure to perform exercises.

8. An exercise system, comprising:

a flexible elongate rod having opposite ends each suitable to be grasped by a user when performing exercises; and at least one end harness, having;

a rod engaging portion, the rod engaging portion operable to be removably engaged with an end of the rod;

an auxiliary engagement portion, the auxiliary engagement portion operable to be engaged with a structure distinct from the rod to enable a user to temporarily secure the rod to the distinct structure to perform exercises; and wherein the rod engagement portion comprises a flap extending from the rod engaging portion, the flap being configured to fit between a closed door and a door jam and terminates in an enlarged portion.

9. The exercise system of claim 8, wherein the rod engaging portion includes a releasable strap, attachable to the rod.

10. The exercise system of claim 8, wherein the distinct structure is a limb of a human body, and wherein the auxiliary engagement portion includes a releasable strap, sized to be releasably attached to the limb.

11. The exercise system of claim 10, wherein the limb is distinct from a limb with which the user is grasping the exercise rod.

12. An exercise device, comprising:

an elongate rod, including:

a flexible inner core having a pair of opposite ends, said inner core consisting essentially of between 60% and 85% (by weight) fiberglass rods, and between 15% and 40% (by weight) of thermoset resin buffer material;

an outer sheath substantially circumscribing the inner core;

a pair of grip sections, each being positioned on an opposing end of the rod, the grip sections being configured to allow a user to securely grasp each end of the rod to perform exercises; and indicating structure associated with the rod, the indicating structure being attached to or formed integrally with the rod and providing a visual indication of a flexural orientation of the rod and wherein the rod engaging portion of the strap comprises a pocket into which one of the opposite ends of the rod is insert able to temporarily secure the strap to the rod.

13. The exercise device of claim 12, wherein the indicating structure includes a visually identifiable marking extending along at least a portion of a side of the rod.

14. The exercise device of claim 13, wherein the visually identifiable marking is formed integrally with the rod.

15. The exercise device of claim 12, wherein the indicating structure comprises an eccentric cross section formed in the rod.

16. The exercise device of claim 12, further comprising:

at least one end cap, fixed to one of the opposite ends of the flexible inner core, the end cap including engaging structure associated therewith to facilitate engagement with a safety strap; and a safety strap, engaged with the end cap and being configured to be releasably secured to the user to prevent accidental release of a grip section of the rod.

17. The exercise device of claim 16, wherein the at least one end cap is comprised of a deformable material and is fixedly crimped onto the rod.

18. The exercise device of claim 16, wherein the engaging structure associated with the end cap comprises an opening.

19. The exercise device of claim 18, wherein the safety strap extends through the opening and includes an enlarged portion sufficiently larger than the opening such that the enlarged portion is prevented from passing through the opening.

20. An exercise system, comprising:

an elongate rod having opposite ends each suitable to be grasped by a user when performing exercises; and at least one end harness, having;

a rod engaging portion, the rod engaging portion operable to be removably engaged with an end of the rod, wherein said rod engaging portion comprises a pocket into which one of the opposite ends of the rod can be inserted temporarily to secure the strap to the rod; and an auxiliary engagement portion, the auxiliary engagement portion operable to be engaged with a structure distinct from the rod to enable a user to temporarily secure the rod to the distinct structure to perform exercises.

21. An exercise system, comprising:

an elongate rod having opposite ends each suitable to be grasped by a user when performing exercises; and at least one end harness, having;

a rod engaging portion, the rod engaging portion operable to be removably engaged with an end of the rod; and an auxiliary engagement portion, the auxiliary engagement portion operable to be engaged with a structure distinct from the rod to enable a user to temporarily secure the rod to the distinct structure to perform exercises, wherein said auxiliary engagement portion comprises;

a flap extending from the rod engaging portion, the flap being configured to fit between a closed door and a doorjamb and terminating in an enlarged portion; the enlarged portion being sized to be unable to fit between the closed door and the doorjamb.

22. The exercise system of claim 21, wherein the flap includes one of: a pocket or an opening formed or defined therein.

* * * * *